US010829995B2

(12) United States Patent
Tonti et al.

(10) Patent No.: US 10,829,995 B2
(45) Date of Patent: Nov. 10, 2020

(54) DOWNHOLE TOOL FOR GENERATING VIBRATION IN A TUBULAR

(71) Applicant: TEAM OIL TOOLS, LP, The Woodlands, TX (US)

(72) Inventors: Nick Tonti, The Woodlands, TX (US); Carl Martin, The Woodlands, TX (US); Justin Kellner, Adkins, TX (US)

(73) Assignee: INNOVEX DOWNHOLE SOLUTIONS, INC., Houston, TX (US)

( * ) Notice: Subject to any disclaimer, the term of this patent is extended or adjusted under 35 U.S.C. 154(b) by 275 days.

(21) Appl. No.: 15/674,771

(22) Filed: Aug. 11, 2017

(65) Prior Publication Data

US 2018/0051518 A1 Feb. 22, 2018

Related U.S. Application Data

(60) Provisional application No. 62/376,659, filed on Aug. 18, 2016.

(51) Int. Cl.

| | |
|---|---|
| ***E21B 7/24*** | (2006.01) |
| ***E21B 34/10*** | (2006.01) |
| ***E21B 21/10*** | (2006.01) |
| *E21B 4/02* | (2006.01) |

(52) U.S. Cl.

CPC ..... *E21B 7/24* (2013.01); *E21B 21/10* (2013.01); *E21B 34/10* (2013.01); *E21B 4/02* (2013.01)

(58) Field of Classification Search

CPC . E21B 7/24; E21B 21/10; E21B 34/10; E21B 4/02

See application file for complete search history.

(56) References Cited

U.S. PATENT DOCUMENTS

| | | | | |
|---|---|---|---|---|
| 3,999,901 | A | 12/1976 | Tschirky | |
| 4,080,115 | A | 3/1978 | Sims et al. | |
| 4,157,022 | A | 6/1979 | Crase | |
| 5,048,622 | A | 9/1991 | Ide | |
| 6,439,318 | B1 * | 8/2002 | Eddison | E21B 7/18 173/91 |
| 6,508,317 | B2 | 1/2003 | Eddison et al. | |
| 8,528,649 | B2 | 9/2013 | Kolle | |
| 2010/0212901 | A1 | 8/2010 | Buytaert | |

* cited by examiner

*Primary Examiner* — Yong-Suk (Philip) Ro

(74) *Attorney, Agent, or Firm* — MH2 Technology Law Group LLP

(57) ABSTRACT

A downhole tool and method for use, in which the tool includes a housing defining a first bore axially therethrough, and a valve shaft disposed in the first bore of the housing. The valve shaft defines a second bore extending axially therein and one or more openings extending radially from the second bore, the valve shaft being rotatable relative to the housing. The tool also includes a valve sleeve disposed in the housing and defining one or more openings extending radially therethrough. The valve shaft is rotatable relative to the valve sleeve, such that the one or more openings of the valve sleeve are periodically aligned and misaligned with the one or more openings of the valve sleeve as the valve shaft rotates.

19 Claims, 5 Drawing Sheets

DOWNHOLE TOOL FOR GENERATING VIBRATION IN A TUBULAR

CROSS-REFERENCE TO RELATED APPLICATIONS

This application claims priority to U.S. Provisional Patent Application Ser. No. 62/376,659, which was filed on Aug. 18, 2016 and is incorporated herein by reference in its entirety.

BACKGROUND

In the oilfield, tools are sometimes used to generate downhole vibration in a drill string or another oilfield tubular. One such tool is known as an "agitator." The generated vibration can be used for a variety of reasons. For example, downhole vibration can produce "hammer" effect, which may increase the performance of the drill bit. Further, the axial vibration can be employed to reduce the effects of friction forces between the wellbore and the drill string, which can be substantial in wells with long horizontal sections. As such, the vibration can increase drilling performance (e.g., rate of penetration), while potentially reducing the weight-on-bit requirements. Other benefits or uses for such vibration may also be seen.

Agitators typically work by converting energy from a flow of fluid (e.g., drilling mud) in the drill string into vibration. The fluid flow is generated by mud pumps at the surface, which pressurize the fluid. A portion of the energy stored in the fluid is converted downhole to rotational movement, e.g., using a positive displacement motor or a turbine. This rotation can then rotate an eccentric mass, generating vibration. Alternatively, the rotation can be used by valves to partially interrupt fluid flow and thereby create pressure pulses, thereby also generating vibration. In some other designs, poppet valves are used to generate the desired vibration by periodically interrupting the fluid flow.

In such tools, it may be advantageous to minimize energy losses, since such energy losses can increase the demands on the mud pumps, reduce efficiency, etc. Further, designs with increased robustness are a welcome addition in the art.

SUMMARY

Embodiments of the disclosure may provide a tool that includes a housing defining a first bore axially therethrough, and a valve shaft disposed in the first bore of the housing. The valve shaft defines a second bore extending axially therein and one or more openings extending radially from the second bore, the valve shaft being rotatable relative to the housing. The tool also includes a valve sleeve disposed in the housing and defining one or more openings extending radially therethrough. The valve shaft is rotatable relative to the valve sleeve, such that the one or more openings of the valve sleeve are periodically aligned and misaligned with the one or more openings of the valve sleeve as the valve shaft rotates.

Embodiments of the disclosure may also provide a method for vibrating an oilfield tubular. The method includes deploying a tool into a wellbore as part of a string of tubulars. The tool includes a housing defining a first bore axially therethrough, a valve shaft disposed in the first bore of the housing, wherein the valve shaft defines a second bore extending axially therein and one or more openings extending radially from the second bore, the valve shaft being rotatable relative to the housing, and a valve sleeve disposed in the housing and defining one or more openings extending radially therethrough. The method further includes pumping a fluid into the string of tubulars. The fluid causes a rotor coupled to the valve shaft to rotate, such that the valve shaft rotates relative to the valve sleeve, wherein the one or more openings of the valve shaft are rotated into and out of alignment with the one or more openings of the valve sleeve as the valve shaft rotates, so as to cause pressure changes in the fluid in the tool Embodiments of the disclosure may further provide a valve assembly for a tool, the valve assembly. The valve assembly includes a housing defining a first bore therein, and a valve shaft disposed in the first bore and being rotatable relative to the housing. The valve shaft defines a second bore extending therein, an opening extending radially outward from the second bore, and an open axial end in communication with the second bore and the first bore. The second bore is in fluid communication with the first bore via the open axial end. The valve assembly also includes a valve sleeve disposed at least partially around the valve shaft, the valve sleeve being prevented from rotating relative to the housing, the valve sleeve comprising an opening extending radially outward therefrom, the opening of the valve sleeve being axially aligned with the opening of the valve shaft, such that the valve sleeve and the valve shaft are configured to allow fluid to flow radially outward from the second bore, through the openings of the valve shaft and the valve sleeve, and into the first bore of the housing, when the openings of the valve sleeve and the valve shaft are aligned.

BRIEF DESCRIPTION OF THE DRAWINGS

The present disclosure may best be understood by referring to the following description and accompanying drawings that are used to illustrate embodiments of the invention. In the drawings.

DETAILED DESCRIPTION

Figure 1:
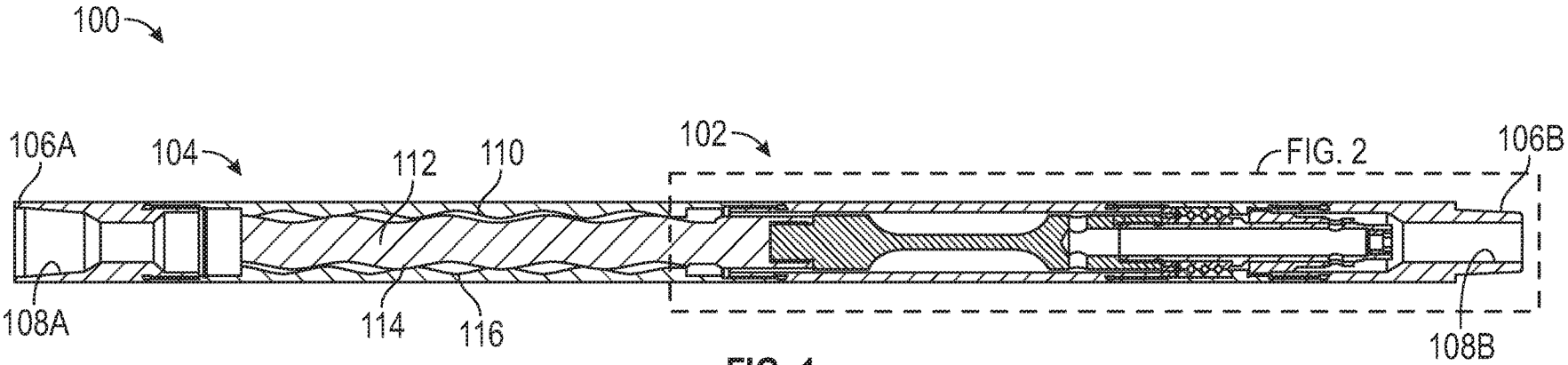
FIG. 1 illustrates a side, cross-sectional view of a downhole tool, according to an embodiment.

The following disclosure describes several embodiments for implementing different features, structures, or functions of the invention. Embodiments of components, arrangements, and configurations are described below to simplify the present disclosure; however, these embodiments are provided merely as examples and are not intended to limit the scope of the invention. Additionally, the present disclosure may repeat reference characters (e.g., numerals) and/or letters in the various embodiments and across the Figures provided herein. This repetition is for the purpose of simplicity and clarity and does not in itself dictate a relationship between the various embodiments and/or configurations discussed in the Figures. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact. Finally, the embodiments presented below may be combined in any combination of ways, e.g., any element from one exemplary embodiment may be used in any other exemplary embodiment, without departing from the scope of the disclosure.

Additionally, certain terms are used throughout the following description and claims to refer to particular components. As one skilled in the art will appreciate, various entities may refer to the same component by different names, and as such, the naming convention for the elements described herein is not intended to limit the scope of the invention, unless otherwise specifically defined herein. Further, the naming convention used herein is not intended to distinguish between components that differ in name but not function. Additionally, in the following discussion and in the claims, the terms "including" and "comprising" are used in an open-ended fashion, and thus should be interpreted to mean "including, but not limited to." All numerical values in this disclosure may be exact or approximate values unless otherwise specifically stated. Accordingly, various embodiments of the disclosure may deviate from the numbers, values, and ranges disclosed herein without departing from the intended scope. In addition, unless otherwise provided herein, "or" statements are intended to be non-exclusive; for example, the statement "A or B" should be considered to mean "A, B, or both A and B."

In general, embodiments of the present disclosure may provide a downhole tool configured to generate vibration as part of a tubular string, e.g., a drill string. The tool may include a mud motor, which may turn a valve shaft relative to a valve sleeve. The valve shaft may be rotatably positioned within a bore of a housing. The valve sleeve may also be in the bore of the housing, but may be prevented from rotating. The valve sleeve and valve shaft both have radial openings, which are axially aligned such that, as the valve shaft rotates, the openings move into and out of circumferential alignment. When the radial openings are circumferentially aligned, fluid may flow from a bore of the valve shaft, radially outward into the bore of the valve housing via the radial openings. Further, a flow restrictor (e.g., orifice) may be received into an open axial end of the valve shaft, so as to choke fluid flow through the axial end of the valve shaft. Accordingly, the pressure generated by choking the flow may be periodically reduced by aligning the openings of the valve sleeve and the valve shaft as the valve shaft rotates. This oscillation of the pressure within the tool may yield vibration in the drill string. Further, the pressure pulse in the fluid may be contained within the tool, as the fluid flowrate into the tool is the same as the fluid flowrate out. These and other aspects of the disclosure will now be described with reference to the illustrated embodiments.

Turning now to the illustrated embodiment, FIG. 1 illustrates a side, cross-sectional view of a downhole tool 100, according to an embodiment. In an embodiment, the downhole tool 100 may be an agitator. The tool 100 generally includes a valve assembly 102 and a motor 104, which are positioned between axial end connectors 106A, 106B of the tool 100. In the illustrated embodiment, the axial end connector 106A is a female, "box-end" connection, which may be internally threaded for connection to an externally-threaded, male, "pin-end" connection of an adjacent tubular (e.g., as part of a drill string). The end connector 106B may be a pin-end connection. Accordingly, the end connector 106A may represent the top or uphole end of the tool 100. In various embodiments, the connections at the ends 106A, 106B may either or both be female connections. The end connectors 106A, 106B may each define a bore 108A, 108B axially therethrough.

The motor 104 may be a positive-displacement motor, as shown. In other embodiments, a turbine-type of motor, or any other motor design that is configured to transfer energy stored in a fluid to mechanical rotation. In the illustrated embodiment, the motor 104 may include a stator 110 and a rotor 112. The rotor 112 may be generally helical, such that, in cross-section, it appears to include a plurality of bulbs 114, which may be positioned within a plurality of corresponding cavities 116 of the stator 110. Further, the rotor 112 and the interior of the stator 110 may be in fluid communication with the bore 108A, such that fluid is received into the stator 110 therefrom. A portion of the energy of the fluid received may be converted into rotation of the rotor 112 via interaction of the fluid with the helical rotor 112 and the cavities 116 of the stator 110. Such rotation may drive the valve assembly 102 to rotate.

Figure 2:
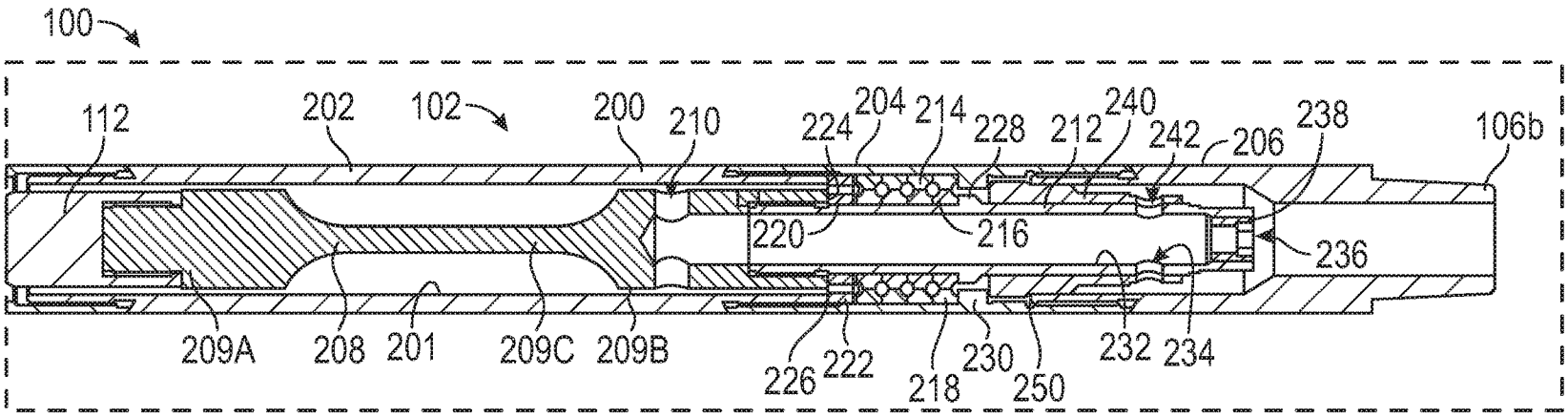
FIG. 2 illustrates an enlarged view of the tool, showing a valve assembly thereof in greater detail, according to an embodiment.

Referring now to FIG. 2, the valve assembly 102 is shown in greater detail, according to an embodiment. The valve assembly 102 may include a housing 200, defining a first bore 201 therein. The housing 200 may be a single, monolithic structure, or, as shown, may be broken into several smaller housings that are connected (e.g., sealed) together. For example, the housing 200 may include a shaft housing 202, a valve housing 204, and a lower sub 206. The lower sub 206 may provide the end connector 106B. Further, the shaft housing 202 may be connected to the stator 110, and may be configured to receive the fluid therefrom into the first bore 201, after the fluid proceeds through the motor 104 and rotates the rotor 112.

A drive or "flex" shaft 208 may be positioned at least partially within the drive housing 202. The drive shaft 208 may be connected to the rotor 112, and may be rotated by rotation thereof. The drive shaft 208 may be welded, pinned, screwed, threaded into or onto, or otherwise attached to the rotor 112. In some embodiments, the drive shaft 208 may be integral with the rotor 112. The drive shaft 208 may have two end sections 209A, 209B and a thin middle section 209C extending therebetween. The end section 209A may be at least partially received into the rotor 112. Further, the drive shaft 208 may include one or more radial openings 210 extending therein, e.g., in the end section 209B. The radial openings 210 may fluidly communicate with first bore 201, and thus may receive fluid therefrom.

The valve assembly 102 may include a valve shaft 212 connected to the drive shaft 208, e.g., the end section 209B thereof The valve shaft 212 may be positioned within the housing 200, e.g., at least partially within the valve housing 204. Further, the valve shaft 212 may be rotatable relative to the housing 200. For example, the valve shaft 212 may be connected (e.g., welded, pinned, screwed, threaded into or onto, or otherwise attached) to the drive shaft 208, so as to rotate therewith. In some embodiments, the drive shaft 208 and the valve shaft 212 may be integral.

A radial bearing 214 may be provided to support rotation of the valve shaft 212. The radial bearing 214 may be any suitable type of bearing, e.g., a roller bearing. The bearing 214 may also be configured to support axial thrust loads, where needed. The bearing 214 may include an inner race 216 and an outer race 218, with the outer race 218 being positioned against the first bore 201 of the housing 200, and the inner race 216 being positioned against the valve shaft 212.

Further, an inner compression ring 220 and an outer compression ring 222 may be provided, which may bear upon the axial end of the inner and outer races 216, 218, respectively. The inner compression ring 220 may bear against an end 224 of the drive shaft 208, while the outer compression ring may bear against a lower axial end 226 of the shaft housing 202. As such, the bearing 214 may be prevented from axial movement toward the drive shaft 208.

Further, the valve shaft 212 and the valve housing 204 may include bearing shoulders 228, 230, respectively. An axial end of the inner race 216 may bear against the bearing shoulder 228, and the outer race 218 may bear against the bearing shoulder 230. As such, the bearing 214 may be prevented from moving axially away from the drive shaft 208. Thus, the bearing 214 may be generally fixed in axial position relative to the housing 200 and the valve shaft 212, although the compression rings 220, 222 may allow for some axial movement of the valve shaft 212 relative to the bearing 214. In some embodiments, two or more bearings 214 may be provided.

Since the valve shaft 212 is journaled in the housing 200 by the bearing 214, and the valve shaft 212 may be rigidly connected to the drive shaft 208, the bearing 214 may thus serve to support the drive shaft 208 and the rotor 112, in addition to the valve shaft 212, potentially obviating a need for a secondary bearing for either or both the rotor 112 and/or the drive shaft 208. In other embodiments, additional bearings may be provided, e.g., for redundancy, efficiency, additional support, etc.

The valve shaft 212 may define a second bore 232 therein, which may extend in an axial direction at least partially, e.g., entirely, through the valve shaft 212. The second bore 232 may fluidly communicate with the first openings 210 of the drive shaft 208, and thus may receive fluid from the first bore 201 via the first openings 210. The valve shaft 212 may further define one or more second openings 234, which may extend radially therethrough (that is, radially through the wall that defines the valve shaft 212). The second openings 234 may extend from the second bore 232 and thus may be in fluid communication therewith.

The valve shaft 212 may further define an axial end opening 236, which may be positioned within the first bore 201, e.g., within the lower sub 206 of the housing 200. Fluid may be expelled from the second bore 232 through the axial end opening 236 and back into the first bore 201 (e.g., below the valve shaft 212, in the lower sub 206 of the housing 200), generally in an axial-direction as proceeding through the axial end opening 236.

Figure 3:
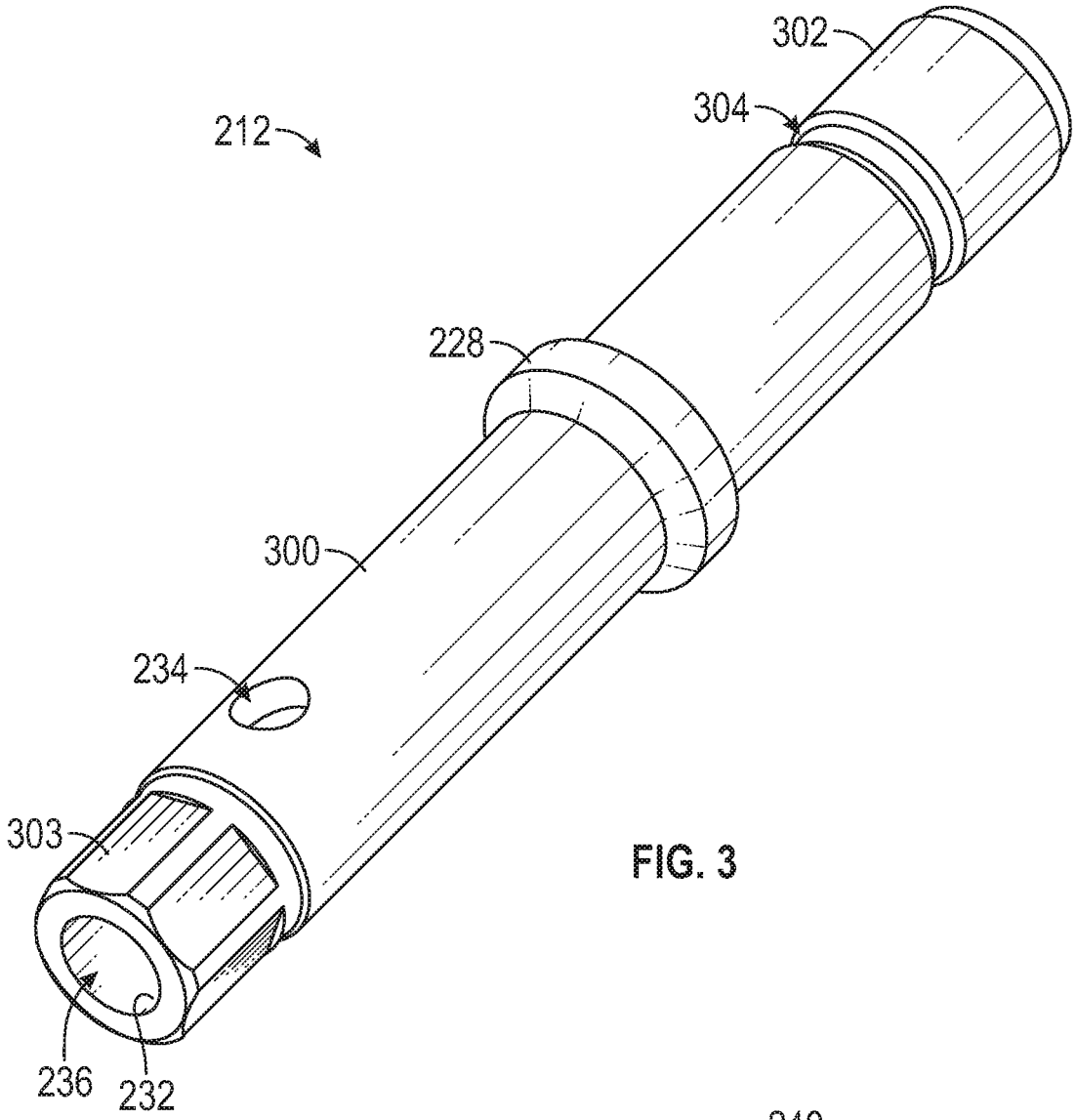
FIG. 3 illustrates a raised, perspective view of a valve shaft of the valve assembly, according to an embodiment.

FIG. 3 illustrates a perspective view of the valve shaft 212, according to an embodiment. As shown, the valve shaft 212 may include the shoulder 228, extending radially outwards from an outer diametral surface 300 of the valve shaft 212. The shoulder 228 may extend continuously around the valve shaft 212, or may be broken into two or more segments separated by a gap. Further, the shoulder 228 may be integral with the rest of the valve shaft 212 or may be a separate collar attached thereto.

The valve shaft 212 may include a connecting portion 302, which may be received into the drive shaft 208 (FIG. 2) for connection therewith. Further, the valve shaft 212 may define a recess 304 therein, e.g., proximate to the connecting portion 302. A seal, such as an O-ring may be seated in the recess 304, so as to assist sealing the valve shaft 212 in the housing 200.

One of the second openings 234 is visible in FIG. 3, extending radially outward through the valve shaft 212 from the bore 201. It will be appreciated that any number of second openings 234 may be provided. The valve shaft 212 may include the axial end opening 236, which may also fluidly communicate with the bore 201. Further, the valve shaft 212 may include flat surfaces 303, which may facilitate engagement of the valve shaft 212 with a tool, such as a wrench, so as to apply torque thereto.

Referring again to FIG. 2, the valve shaft 212 may optionally include a flow restrictor 238, such as an orifice, nozzle, etc., which may be disposed in the axial end opening 236. The flow restrictor 238 may be threaded, pinned, or otherwise removably attached to the valve shaft 212, e.g., within the axial end opening 236. Accordingly, the flow restrictor 238 may be replaceable, e.g., without removing the valve shaft 212 from within the housing 200, and may be sized to provide for a certain flowpath, pressure, flowrate, etc. of fluid flowing therethrough. In some embodiments, several flow restrictors 238 of different sizes may be provided along with the tool 100, so as to allow for selection and/or substitution thereof by the operator.

The tool 100 may include a valve sleeve 240 positioned in the housing 200, e.g., at least partially within the lower sub 206. The valve sleeve 240 may further be positioned around the valve shaft 212, such that the valve sleeve 240 is radially between the valve shaft 212 and the housing 240. Further, the valve shaft 212 may be rotatable relative to the valve sleeve 240. The valve sleeve 240 may be held generally stationary with respect to the housing 200.

The valve sleeve 240 may include one or more third openings 242, which may extend radially through the valve sleeve 240. In embodiments including two or more of the third openings 242, the third openings 242 may be spaced circumferentially apart around the valve sleeve 240. Further, the third openings 242 may be axially-aligned with the second openings 234 of the valve shaft 212. Accordingly, as the valve shaft 212 rotates, the second openings 234 thereof may be intermittently moved circumferentially into alignment with the third openings 242, allowing fluid communication from the bore 232 through the second and third openings 234, 242, and into the portion of the bore 201 defined in the lower sub 206. When the second and third openings 234, 242 are circumferentially misaligned, the valve sleeve 240 may prevent fluid communication from the bore 232 radially outwards into the bore 201; however, the axial end opening 236 may continue to allow for fluid flow from the bore 232 into the bore 201 in the axial direction. This alignment and misalignment may be considered "periodic" in that it occurs over intervals, although this term should not be considered as requiring strictly uniform periods of alignment/misalignment as between different (e.g., sequential) rotations of the valve shaft 212.

Figure 4:
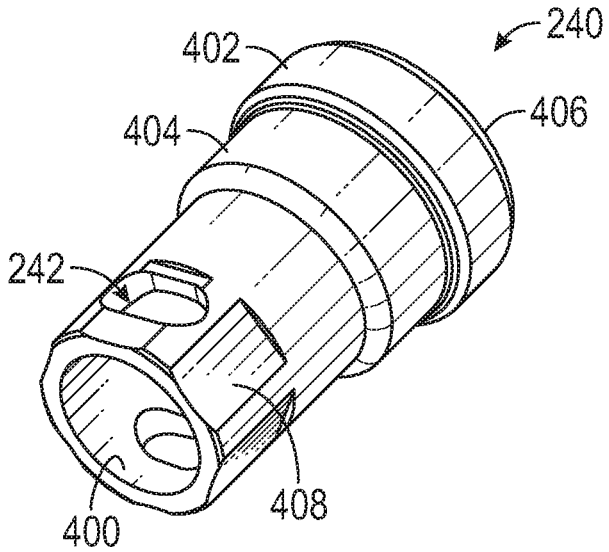
FIG. 4 illustrates a raised, perspective view of a valve sleeve of the valve assembly, according to an embodiment.
Figure 5:
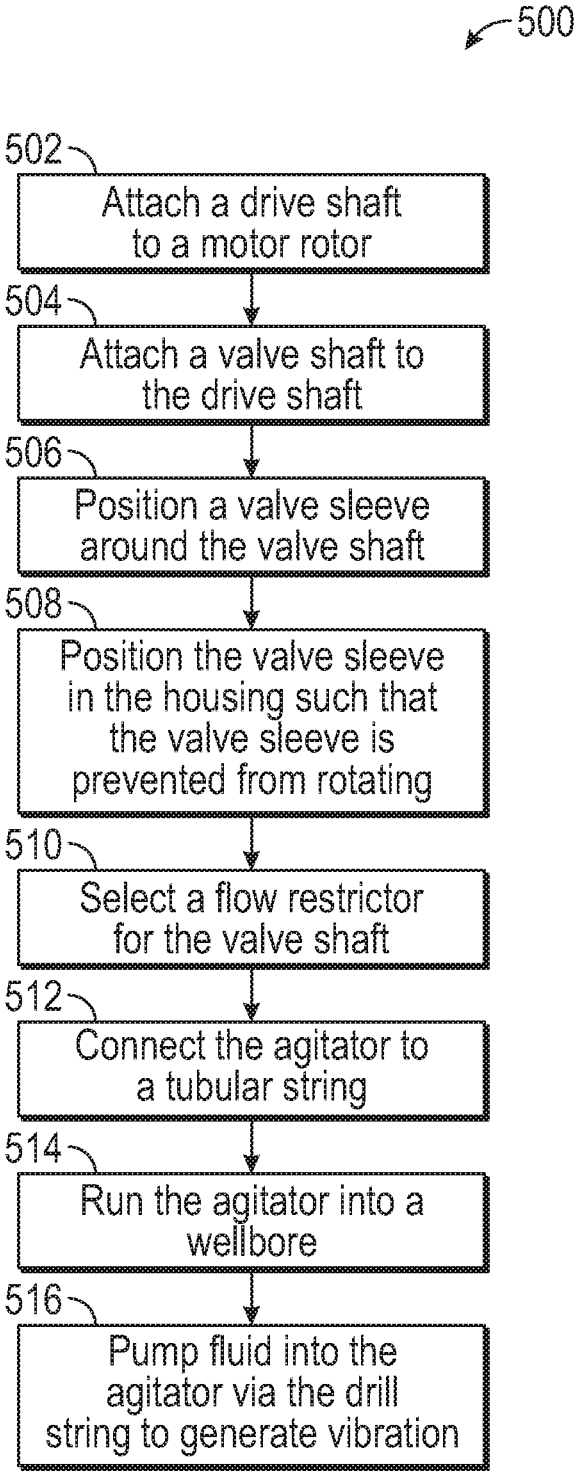
FIG. 5 illustrates a flowchart of a method for generating vibrations in an oilfield tubular, according to an embodiment.

FIG. 4 illustrates a perspective view of the valve sleeve 240, according to an embodiment. The valve sleeve 240 defines a bore 400, which may be sized to receive the outer diametral surface 300 of the valve shaft 212 (e.g., FIG. 3), but may not be large enough to pass over the shoulder 228. Further, the valve sleeve 240 may include a stepped profile, defining one or more radially-extending shoulders. For example, the valve sleeve 240 may include a first shoulder 402 and a second shoulder 404. The first shoulder 402 may be positioned at a first axial end 406 of the valve sleeve 240, and the second shoulder 404 may be positioned axially-adjacent thereto.

As shown, the valve sleeve 240 includes the third openings 242 extending radially therethrough. The third openings 242 may be elongated as compared to the second openings 234, but may, in various embodiments, have any suitable shape. The elongation may, for example, increase the amount of time the second and third openings 234, 242 remain in circumferential alignment while the valve shaft 212 rotates relative to the valve sleeve 240 at a given speed. Further, the valve sleeve 240 may include flat surfaces 408, which may assist in gripping the valve sleeve 240 with a tool, such as a wrench, and applying a torque thereto.

With continuing reference to FIG. 4 and additional reference to FIG. 2, the first shoulder 402 may be entrained between the shoulder 230 of the valve housing 204 and an axial end 250 of the lower sub 206. Further, the second shoulder 404 may bear on the portion of the bore 201 defined by the lower sub 206. Accordingly, attaching (e.g., screwing) the lower sub 206 to the valve housing 204 may serve to hold the valve sleeve 240 in place therebetween. In addition, in some embodiments, the axial end 406 of the valve sleeve 240 may be spaced axially apart from the shoulder 228, so as to avoid resisting relative rotation between the valve sleeve 240 and the valve shaft 212.

Although not shown, in some embodiments, the flow restrictor 238 may be placed into an axial end opening of the valve sleeve 240. As such, fluid may flow through the valve sleeve 240, out the axial end opening 236 thereof, and then through the flow restrictor 238. Further, the tool 100 may include one or more seals between the components thereof, e.g., between the components of the housing 200 and between the drive shaft 208 and the valve shaft 212, so as to maintain pressure containment within the tool 100.

With additional reference to FIGS. 1-4, FIG. 5 illustrates a flowchart of a method 500 for generating vibrations in an oilfield tubular, according to an embodiment. The method 500 may proceed by operation of one or more embodiments of the tool 100 discussed above, and is thus described herein with reference thereto; however, it will be appreciated that some embodiments of the method 500 may be executed using other devices, and thus the method 500 should not be considered limited to any physical structures unless otherwise stated herein.

The method 500 may include attaching the drive shaft 208 to the rotor 112, as at 502. The rotor 112 may be configured to be rotated, within and relative to the stator 110, by pumping a fluid into a tubular string, which is received into the stator 110. The drive shaft 208 is caused to rotate by the rotation of the rotor 112. The drive shaft 208 may be positioned within the bore 201 of the housing 200, and the bore 201 may be in fluid communication with the interior of the stator 110, so as to receive from the stator 110 the fluid pumped into the tubular string.

The method 500 may also include attaching the drive shaft 208 to the valve shaft 212 in the bore 201 of the housing 200, as at 504. The valve shaft 212 is rotatably supported within the housing 200, e.g., using the bearing 214. Further, the valve shaft 212 is in fluid communication with the bore 201, e.g., via the first openings 210 formed in the drive shaft 208.

The method 500 may include positioning the valve sleeve 240 around the valve shaft 212, as at 506, and positioning the valve sleeve 240 in the housing 200 such that the valve sleeve 240 is prevented from rotating relative to the housing 200, as at 508. The valve shaft 212 may include the second openings 234, which may be axially aligned with the third openings 242 of the valve sleeve 240. Further, the second openings 234 may be in communication with the bore 201 via the bore 232 through the valve shaft 212 and the first openings 210 in the drive shaft 208. The valve shaft 212 may also be in fluid communication with the bore 201, below the valve shaft 212, via the axial end opening 236.

The method 500 may include selecting the flow restrictor 238 for the valve shaft 212 from a plurality of flow restrictors, as at 510. The plurality of flow restrictors may, for example, include differently-sized orifices, which may allow for different pressure profiles in the tool 100 during operation. The selected flow restrictor 238 may then be inserted into and/or otherwise connected to the axial end opening 236 of the valve shaft 212 (or the valve sleeve 240, as noted above).

Figure 6:
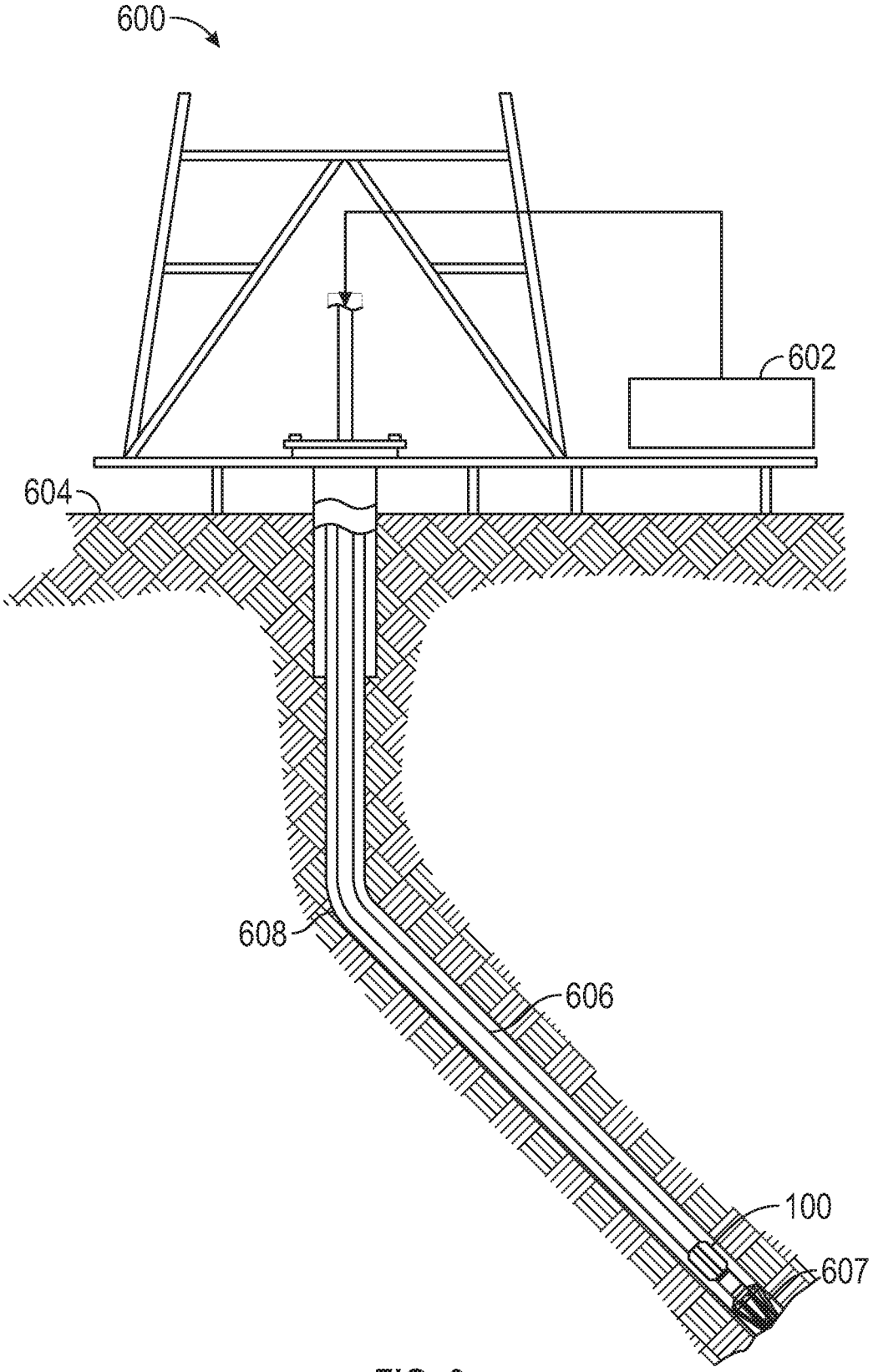
FIG. 6 illustrates a simplified schematic view of a drilling system, according to an embodiment.

The method 500 may include various other actions, such as connecting together the various elements of the housing 200 together, to complete assembly of the tool 100. The method 500 may then include connecting the tool to a tubular string (e.g., a drill string), using the end connectors 106A, 106B. FIG. 6 illustrates a simplified schematic view of a drilling system 600, which may facilitate gaining an understanding of the context of use of the tool 100. As shown, the drilling system 600 includes one or more mud pumps 602 at a top surface 604. The mud pumps 602 are connected to a tubular (e.g., drill) string 606 that terminates with a drill bit 607 (e.g., as part of a larger bottom-hole assembly) that is used to drill a wellbore 608. As shown, the tool 100 is connected on either axial end to tubulars, becoming part of the drill string 606, so as to receive fluid from the mud pumps 602.

Referring again to FIG. 5, the method 500 may include deploying or "running" the tool 100 into the wellbore 608, as part of the tubular string, as at 510. The method 500 may then include pumping fluid into the tubular string, as at 512. The pumped fluid may be received into the stator 110 of the tool 100, causing the rotor 112 to rotate. Such rotation in turn causes the drive shaft 208 and the valve shaft 212 to rotate. The fluid is received into the bore 232 of the valve shaft 212 via the first openings 210 in the drive shaft 208. At least a portion of the fluid may then proceed axially through the axial end opening 236, via the flow restrictor 238, and into the bore 201, e.g., in the lower sub 206. The fluid may then proceed from the bore 201 into a subjacent tubular of the tubular string.

As the valve shaft 212 rotates, the second openings 234 may rotate into alignment with the third openings 242, allowing some of the fluid to flow radially outward therethrough, and into the bore 201. In the bore 201, the fluid that flows through the second and third openings 234, 242 may combine with the fluid that flows through the axial end opening 236 and the restrictor 238. Thus, the "opening" of the valve assembly 102 (i.e., when the second and third openings 234, 242 are aligned and allow fluid to flow therethrough) may reduce resistant to fluid flow through the tool 100. In turn, this reduces fluid pressure in the tool 100.

As the valve shaft 212 continues to rotate relative to the valve sleeve 240, the flowpath defined by the combination of the second and third openings 234, 242 may reduce, and eventually become fully blocked when the second and third openings 234, 242 are moved out of alignment by such rotation. This is the "closing" of the valve assembly 102. As the flowpath reduces and the valve assembly 102 closes, fluid is forced to flow through the restrictor 238, which may increase resistance to fluid flow through the tool 100, thereby increasing pressure in the tool 100. Once the second and third openings 234, 242 are completely out of alignment and the flowpath therebetween is closed, the fluid may only via the axial end opening 236 and the flow restrictor 238. This yields a pressure spike in the tool 100. Thus, as the valve shaft 212 rotates, the pressure oscillates between a minimum when the second and third openings 234, 242 are fully aligned, and a maximum when the second and third openings 234, 242 are completely out of alignment. The pressure surrounding the tool 100 may be substantially constant, and thus such pressure fluctuations in the tool 100 may result in an oscillating pressure differential across the tool 100, thereby yielding vibration in the tubular string.

Accordingly, it will be appreciated that the embodiment of the tool 100 described above may be readily adjusted, e.g., in the field or "on-the-fly" by selection of the appropriate flow restrictor 238, which may alter the pressure profile of the tool 100. Further, the annular arrangement of the second and third openings 234, 242 may increase sealing capabilities, as flow may be fully cut-off through the second and third openings 234, 242. In addition, the pressure pulse in the fluid may be substantially contained in the tool, as flow rate in may be equal to flow rate out, and no fluid is ejected radially out of the tubular string. Moreover, the tool 100 may prevent wash out and may allow for increased wall thickness.

Figure 7:
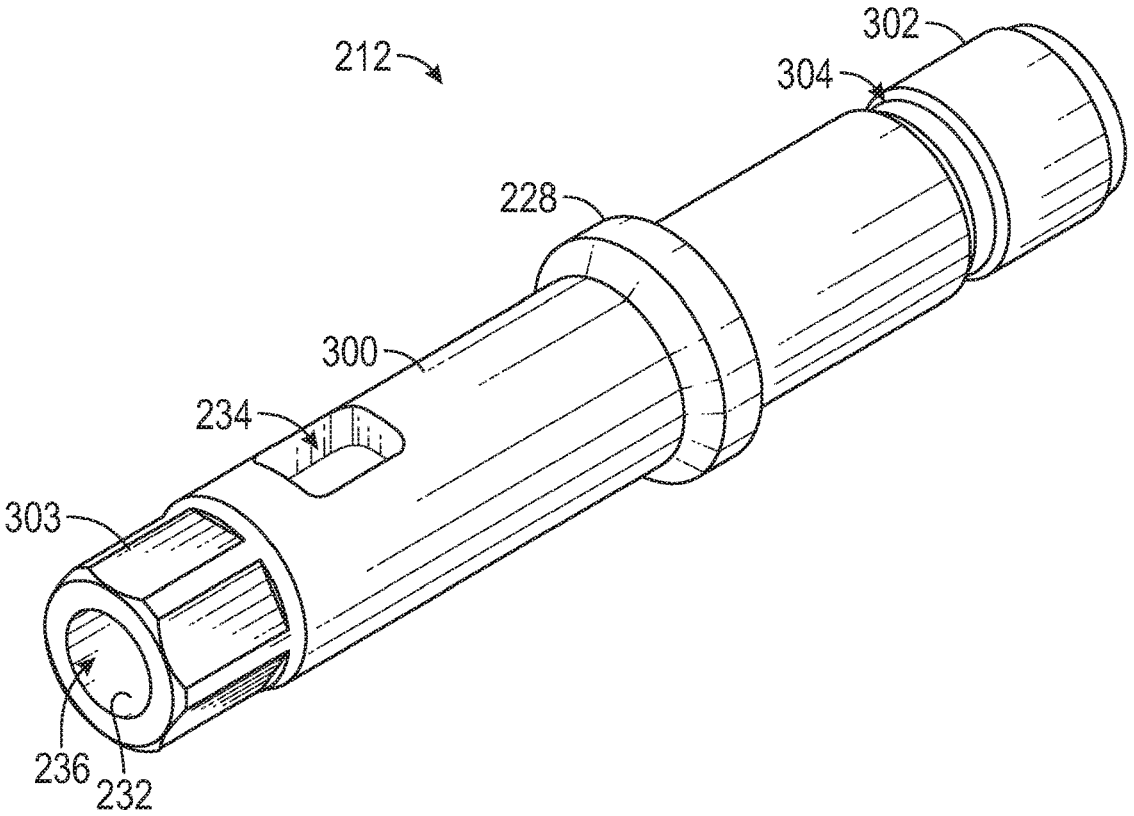
FIG. 7 illustrates a raised, perspective view of another embodiment of the valve shaft of the valve assembly, according to an embodiment.

FIG. 7 illustrates a raised, perspective view of another embodiment of the valve shaft 212 of the valve assembly 102. The embodiment of FIG. 7 may be similar to the embodiment of FIG. 3, discussed above; therefore, like parts are indicated with like reference numbers and duplicative descriptions are omitted. The second opening 234 of the valve shaft 212 in FIG. 7 may have more squared (e.g., with rounded corners) shape than in FIG. 3. Further, a single second opening 234 may be employed, or several may be spaced circumferentially apart around the valve shaft 212.

Figure 8:
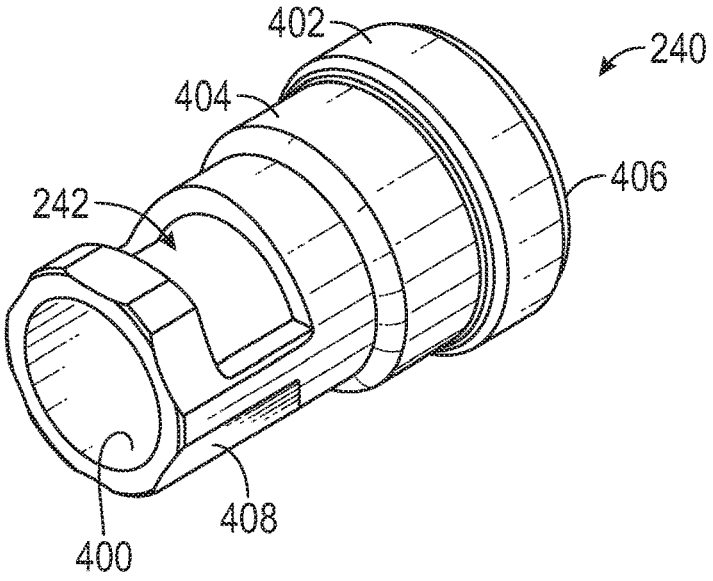
FIG. 8 illustrates a raised, perspective view of another embodiment of the valve sleeve of the valve assembly.

FIG. 8 illustrates a raised, perspective view of another embodiment of the valve sleeve 240 of the valve assembly 102, according to an embodiment. The embodiment of FIG. 8 may be similar to the embodiment of FIG. 4, discussed above; therefore, like parts are indicated with like reference numbers and duplicative descriptions are omitted. The third opening 242 of the valve sleeve 240 in FIG. 8 may be larger than the third opening 242 in FIG. 3. Further, the third opening 242 in FIG. 8 may be larger, such that a single third opening 242 may be provided. The third opening 242 in FIG. 8 may extend at least about 100 degrees around the circumference of the valve sleeve 240, e.g., up to about 180 (or more) degrees.

Referring to both FIGS. 7 and 8, the valve shaft 212 may be employed with the valve sleeve 240, in a similar manner as that discussed above with respect to the embodiments of FIGS. 3 and 4, to induce vibrations in a tubular string. As such, the valve shaft 212 may rotate, such that the second opening 234 is moved into and out of circumferential alignment with the third opening 242, thereby creating intermittent fluid pulses from within the bore 232 and into the housing 200 (see, e.g., FIG. 2). It will be appreciated that the valve shaft 212 of FIG. 7 may be employed with the valve sleeve 240 of FIGS. 4, and the valve sleeve 240 of FIG. 8 may be employed with the valve shaft 212 of FIG. 3.

As used herein, the terms "inner" and "outer"; "up" and "down"; "upper" and "lower"; "upward" and "downward"; "above" and "below"; "inward" and "outward"; "uphole" and "downhole"; and other like terms as used herein refer to relative positions to one another and are not intended to denote a particular direction or spatial orientation. The terms "couple," "coupled," "connect," "connection," "connected," "in connection with," and "connecting" refer to "in direct connection with" or "in connection with via one or more intermediate elements or members." The term "axial" refers to a direction parallel to a central longitudinal axis of the tool 100, and the term "radial" refers to a direction perpendicular to axial (i.e., toward and away from the central longitudinal axis).

The foregoing has outlined features of several embodiments so that those skilled in the art may better understand the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions, and alterations herein without departing from the spirit and scope of the present disclosure.

What is claimed is:

1. A downhole tool, comprising:

a housing defining a first bore axially therethrough;

a valve shaft disposed in the first bore of the housing, wherein the valve shaft defines a second bore extending axially therein and one or more openings extending radially from the second bore, the valve shaft being rotatable relative to the housing, and wherein the valve shaft defines an open axial end that is positioned within the first bore;

a flow restrictor that is removably positioned in the open axial end of the valve shaft and configured to permit fluid flow therethrough out of the valve shaft and into the first bore of the housing; and a valve sleeve disposed in the housing and defining one or more openings extending radially therethrough, the valve shaft being rotatable relative to the valve sleeve, such that the one or more openings of the valve sleeve are periodically aligned and misaligned with the one or more openings of the valve sleeve as the valve shaft rotates.

2. The tool of claim 1, wherein the valve shaft is configured such that fluid flows from the second bore into the first bore via the open axial end and the flow restrictor, without regard to the alignment or misalignment of the one or more openings of the valve sleeve and the one or more openings of the valve shaft.

3. The tool of claim 1, wherein the housing prevents fluid from exiting radially outward from within the first bore.

4. The tool of claim 1, further comprising a bearing positioned between and engaging the valve shaft and the housing, to support the valve shaft and allow rotation thereof with respect to valve housing.

5. The tool of claim 4, further comprising a drive shaft coupled to the valve shaft, such that the bearing at least partially supports the drive shaft.

6. The tool of claim 5, wherein the drive shaft defines one or more openings therein in fluid communication with the first bore, the one or more openings of the drive shaft also being in fluid communication with the second bore through the valve shaft.

7. The tool of claim 5, further comprising a motor comprising a stator and a rotor disposed within the stator, the rotor being coupled to the drive shaft, to rotate the drive shaft.

8. The tool of claim 7, wherein the stator is coupled to the housing, and wherein the motor is in fluid communication with the one or more openings of the drive shaft.

9. The tool of claim 5, wherein the housing comprises:

a lower sub in which the valve sleeve is positioned;

a valve housing coupled to the lower sub, at least a portion of the valve sleeve and at least a portion of the valve shaft being positioned within the valve housing; and a drive housing in which at least a portion of the drive shaft is positioned.

10. The tool of claim 9, wherein:

the valve housing comprises an inner shoulder;

the lower sub comprises an upper axial end spaced axially apart from the inner shoulder; and the valve sleeve comprises an outer shoulder that is entrained between the upper axial end of the lower sub and the inner shoulder of the valve housing.

11. The tool of claim 1, further comprising a plurality of flow restrictors each having a different flowpath area therethrough, wherein the flow restrictor is selected from the plurality of flow restrictors based on flowpath area.

12. The tool of claim 1, wherein the valve shaft and the flow restrictor are configured to permit fluid flow through the flow restrictor regardless of whether the one or more openings of the valve shaft are aligned or misaligned with the one or more openings of the valve sleeve.

13. The tool of claim 1, wherein the valve shaft and the valve sleeve are held in a generally stationary axial position within the housing.

14. The tool of claim 1, wherein the flow restrictor is configured to direct the fluid flow in a downhole direction, toward a drill bit at an end of a drill string, the tool being configured to be coupled to the drill string, uphole of the drill bit.

15. The tool of claim 1, wherein the flow restrictor is removable from within the open axial end of the valve shaft without removing the valve shaft from within the housing.

16. A valve assembly for a downhole tool, the valve assembly comprising:

a housing defining a first bore therein;

a valve shaft disposed in the first bore and being rotatable relative to the housing, the valve shaft defining a second bore extending therein, an opening extending radially outward from the second bore, and an open axial end in communication with the second bore and the first bore, the second bore being in fluid communication with the first bore via the open axial end;

a flow restrictor removably positioned in the open axial end of the valve shaft and configured to permit fluid flow therethrough out of the valve shaft and into the first bore of the housing; and a valve sleeve disposed at least partially around the valve shaft, the valve sleeve being prevented from rotating relative to the housing, the valve sleeve comprising an opening extending radially outward therefrom, the opening of the valve sleeve being axially aligned with the opening of the valve shaft, wherein rotation of the valve shaft relative to the valve sleeve causes the opening of the valve sleeve to be intermittently circumferentially aligned with the opening of the valve shaft, which causes fluid to intermittently flow radially outward from the second bore, through the openings of the valve shaft and the valve sleeve that are circumferentially aligned, and into the first bore of the housing.

17. The valve assembly of claim 16, wherein the housing prevents fluid from flowing radially outward from the first bore.

18. The valve assembly of claim 16, wherein the flow restrictor is configured to permit fluid to flow axially from the second bore of the valve sleeve into the first bore of the housing.

19. The valve assembly of claim 16, further comprising a drive shaft coupled to the valve shaft, wherein the drive shaft defines an opening extending radially therethrough, the opening of the drive shaft being in communication with the second bore of the valve shaft.

* * * * *